US007776416B2

(12) United States Patent
Kinard et al.

(10) Patent No.: US 7,776,416 B2
(45) Date of Patent: Aug. 17, 2010

(54) CASE-READY PACKAGE HAVING ABSORBENT PAD

(75) Inventors: David L. Kinard, Grenada, MS (US); G. Franklin Vaughn, Jr., Winona, MS (US); Solomon Bekele, Taylors, SC (US); Charles Kannankeril, North Caldwell, NJ (US)

(73) Assignee: Cryovac, Inc., Duncan, SC (US)

( * ) Notice: Subject to any disclaimer, the term of this patent is extended or adjusted under 35 U.S.C. 154(b) by 1860 days.

(21) Appl. No.: 09/933,291

(22) Filed: Aug. 20, 2001

(65) Prior Publication Data

US 2003/0035867 A1 Feb. 20, 2003

(51) Int. Cl.
*B32B 27/12* (2006.01)
*B32B 25/02* (2006.01)

(52) U.S. Cl. ..... 428/36.1; 428/34.1; 428/35.7; 428/36.2; 426/35; 426/124; 426/129; 426/130; 426/132; 426/133; 426/396; 426/404; 426/411; 206/204

(58) Field of Classification Search ..... 426/129, 426/124, 130, 396, 404, 411, 132, 133, 35; 206/204; 428/34.1, 35.7, 36.1, 36.2
See application file for complete search history.

(56) References Cited

U.S. PATENT DOCUMENTS

| | | | | | |
|---|---|---|---|---|---|
| RE30,009 | E | | 5/1979 | Perdue et al. | 53/433 |
| 4,743,244 | A | * | 5/1988 | LeKhac | 604/376 |
| 5,118,561 | A | | 6/1992 | Gusavage et al. | 428/304.4 |
| 5,135,787 | A | | 8/1992 | Bair | |
| 5,176,930 | A | * | 1/1993 | Kannankeril et al. | 426/124 |
| 5,250,310 | A | * | 10/1993 | Fujino et al. | 426/124 |
| 5,320,895 | A | | 6/1994 | Larsonneur et al. | |
| 5,346,735 | A | | 9/1994 | Logan et al. | 428/36.7 |
| 5,348,752 | A | | 9/1994 | Gorlich | 426/129 |
| 5,439,132 | A | | 8/1995 | Gorlich | 220/359 |
| 5,552,169 | A | | 9/1996 | Kannankeril et al. | 426/107 |
| 5,709,897 | A | * | 1/1998 | Pearlstein | 426/106 |
| 5,770,287 | A | | 6/1998 | Miranda et al. | 428/40.1 |
| 5,804,241 | A | * | 9/1998 | Isohata | 426/415 |
| 5,834,077 | A | | 11/1998 | Babrowicz | 428/34.9 |
| 5,919,547 | A | | 7/1999 | Kocher et al. | 428/138 |
| 6,015,582 | A | * | 1/2000 | Kageyama et al. | 426/392 |

(Continued)

FOREIGN PATENT DOCUMENTS

| | | |
|---|---|---|
| FR | 2 290 153 | 6/1976 |

(Continued)

OTHER PUBLICATIONS

U.S. Appl. No. 09/163,747, filed Sep. 30, 1998.

(Continued)

*Primary Examiner*—Marc A Patterson
(74) *Attorney, Agent, or Firm*—Rupert B. Hurley, Jr.

(57) ABSTRACT

A case-ready package has a support member, a lid, and an absorbent pad capable of withstanding sudden evacuation without rupture. The absorbent pad has upper and lower webs enveloping an absorbent layer, with the upper and lower webs adhered to one another around the periphery of the pad. The lower web is a permeable web comprising fiber. The fiber is preferably hydrophobic, and preferably has a hydrophilic composition thereon. The invention also pertains to a packaging process and packaged product using the absorbent pad.

20 Claims, 1 Drawing Sheet

U.S. PATENT DOCUMENTS

| | | | | |
|---|---|---|---|---|
| 6,042,862 | A | 3/2000 | Kocher et al. | |
| 6,044,622 | A | 4/2000 | Brady et al. | 53/412 |
| 6,221,411 | B1 * | 4/2001 | Sanfilippo et al. | 426/129 |
| 6,447,826 | B1 * | 9/2002 | Matthews | 426/126 |
| 6,491,993 | B1 * | 12/2002 | Forbes et al. | 428/34.3 |
| 6,579,595 | B2 * | 6/2003 | Lemaire | 428/174 |
| 2002/0182102 | A1 * | 12/2002 | Fontenot et al. | 422/5 |

FOREIGN PATENT DOCUMENTS

| | | | |
|---|---|---|---|
| GB | 2296905 | A * | 7/1996 |
| GB | 2 325 195 | A | 11/1998 |
| JP | 9-215706 | | 8/1997 |
| WO | WO 9204254 | A1 * | 3/1992 |
| WO | 97/30909 | | 8/1997 |
| WO | 00/78635 | A1 | 12/2000 |

OTHER PUBLICATIONS

Cirracol® PP842, brochure.
"Reemay Spunbonded Polyester", brochure.

* cited by examiner

CASE-READY PACKAGE HAVING ABSORBENT PAD

FIELD OF THE INVENTION

The invention relates to the field of packaging, especially food packaging. More particularly, the invention pertains to the packaging of food products which exude juice, such as meat products, with the package containing an absorbent pad for soaking up the excess liquid. The invention is particularly directed to a package designed to be placed into a display case for sale, i.e., a "case-ready" package.

BACKGROUND OF THE INVENTION

Various forms of packaging, particularly for food products such as meat and poultry, employ a relatively rigid support member, such as a flat sheet or tray, upon or in which a product is supported. The product is typically covered by a relatively flexible, transparent film. The film is bonded to the support member around the product, generally by forming a heat-seal between the film and support member, to thereby enclose the product between the film and support member. Examples of this type of packaging include vacuum skin packaging and modified-atmosphere packaging.

In vacuum skin packaging, the film is thermoformable, i.e., capable of being formed into a desired shape upon the application of heat, and is thermoformed about the product on a support member by means of heat and differential pressure. Virtually all of the air is evacuated from the interior of the package so that the film conforms very closely to the contour of the packaged product. Generally, sufficient heat is applied to cause the film to bond with the support member outside the periphery of the product, either by employing a heat-activatable adhesive at the interface of the film and support member or by forming the film and support member from materials that are otherwise sealingly compatible upon the application of heat, e.g., by employing similar polymeric materials, such as polyethylenes, at the seal interface that bond to one another when heated. Alternatively, a pressure-sensitive adhesive can be used. Further details are described in, e.g., U.S. Pat. No. Re 30,009 (Purdue et al.), U.S. Pat. No. 5,346,735 (Logan et al.), and U.S. Pat. No. 5,770,287 (Miranda et al.), the disclosures of which are hereby incorporated, in their entireties, by reference thereto.

In modified-atmosphere packaging, a food product is generally packaged in a tray-like support member having a peripheral flange to which the film is secured. Prior to securing the film to the support member, air is generally evacuated from the interior of the support member and replaced by a gas which extends the shelf-life of the packaged product.

In these and similar types of packaging applications, both the film and support member generally comprise materials which form a barrier to the passage of gas therethrough so that the package is, at least initially, substantially gas-impermeable. Eventually, a portion of the film is removed by a retailer prior to placing the package in a display case for consumer purchase. The latter event occurs where it is desirable to increase the gas-permeability of the film in order to allow air (particularly oxygen) to come into contact with the packaged product while still providing protection to the product from dirt, dust, moisture, and other contaminates. This is generally desirable where air-contact with the packaged product renders the product more appealing to the consumer in some way.

While a low-oxygen packaging environment generally increases the shelf-life of a packaged fresh red meat product (relative to meat products packaged in an environment having a higher oxygen content), red meat has a tendency to assume a purple color when packaged in the absence of oxygen or in an environment having a very low oxygen concentration, i.e., below about 5% oxygen. Such a purple color is undesirable to most consumers, and marketing efforts to teach the consumer about the acceptability of the purple color have been largely ineffective. When meat is exposed to a sufficiently high concentration of oxygen, e.g., as found in air, it assumes a bright red color which most consumers associate with freshness. After 1 to 3 days of such exposure, however, meat assumes a brown color which, like the purple color, is undesirable to most consumers (and indicates that the meat is beginning to spoil). Thus, in order to effectively butcher and package fresh red meat products in a central facility for distribution to retail outlets, the meat is packaged, shipped, and stored in a low-oxygen (vacuum or modified-atmosphere) environment for extended shelf-life, and then displayed for consumer sale in a relatively high-oxygen environment such that the meat is caused to "bloom" into a red color just before being placed in a retail display case.

The foregoing may be accomplished by providing a film that peelably delaminates into a gas-permeable portion and a substantially gas-impermeable portion, with the gas-permeable portion being bonded to the support member so that the gas-impermeable portion can be peelably removed from the package. In this manner, the package may be shipped with the upper, gas-impermeable portion secured to the lower, gas-permeable portion to maintain a low-oxygen environment within the package during shipping. Then, the gas-impermeable portion may be peelably removed at the supermarket just prior to placing the package in a retail display case. Since the remaining portion of the film is permeable to gas (oxygen), it allows the meat product to bloom in the presence of oxygen which enters the package from the ambient atmosphere. This general packaging concept is also applicable to poultry, which assumes a pink color in the presence of oxygen but has a longer shelf-life in a low-oxygen environment, as well as to other perishable foods such as cheese and produce.

Regardless of the particular type of peelable package that is employed, e.g., a vacuum skin package or modified-atmosphere package, in the packaging of some products it is desirable to provide the package with an absorbent pad to soak up juices exuded by the food product. This is particularly true for the packaging of beef, lamb, poultry, and pork. The presence of free juice within the package produces an undesirable appearance to consumers, and can provide an environment for bacteriological growth within the package. It is preferred that the absorbent pad is positioned under the meat product, out of the consumer's line of sight.

During the preparation of a case-ready package of either the vacuum skin package type or the modified atmosphere type, it is desirable to rapidly evacuate the atmosphere from around the food product, tray member, and absorbent pad between the food product and the tray member. The evacuation occurs before adhering the covering film (i.e., lid film) over the tray. It has been found that the desired rapid evacuation of the atmosphere during the packaging process can cause a rupturing of the seal around an absorbent pad which has an absorbent layer enveloped by upper and lower films affixed to one another around the periphery of the pad. During evacuation, the atmosphere within the pad may not escape from the pad rapidly enough to prevent a rupture of the envelope. If the envelope ruptures, the absorbent material making up the pad may escape and adhere to the meat product, producing an appearance which is undesirable to consumers. It would be desirable to provide a pad having the absorbent layer enveloped by upper and lower webs affixed to one another around the perimeter of the pad, with the pad being able to withstand sudden evacuation of atmosphere therefrom without rupture.

SUMMARY OF THE INVENTION

The present invention is directed to a case-ready package having an absorbent pad in which the absorbent layer is enveloped by upper and lower webs which are affixed to one another around the perimeter of the pad. It has been discovered that the absorbent pad is capable of withstanding sudden evacuation without rupture if the pad comprises a fibrous web having passageways therethrough which are small enough to prevent escape of the absorbent components from the pad. Upon sudden evacuation, the atmosphere within this pad can quickly pass through the fibrous web without allowing significant pressure to build up within the pad.

As a first aspect, the present invention is directed to a case-ready package for containing a food product which exudes juice. The package is made from a support member, a lid member comprising a flexible film, and an absorbent pad. The absorbent pad comprises an upper web comprising a flexible film, a liquid-permeable lower fibrous web (which preferably is a nonwoven fibrous web), and an absorbent layer between the upper sheet and the lower sheet. The fiber preferably comprises hydrophobic fiber having a hydrophilic composition thereon. The upper and lower webs extend outward of (i.e., outwardly past) the absorbent layer. The upper and lower webs are attached to one another around an entire outer perimeter portion of the pad, with the upper and lower webs together surrounding and containing the absorbent layer within the absorbent pad.

Preferably, the fiber has a hydrophilic composition thereon. If the lower web is made of hydrophobic fiber without such a composition thereon, it has been found that the liquid will not be absorbed into the pad quickly enough. Providing a hydrophilic composition on the fiber of the lower web has been discovered to render the lower web effective in quickly bringing the liquid into the absorbent pad.

In one embodiment, the package has a modified atmosphere between the support member and the lid member. The modified atmosphere can comprise oxygen in an amount of from 60 to 80 percent, based on total atmospheric volume within the package. Preferably, the balance of the atmosphere comprises carbon dioxide and/or nitrogen. A particularly preferred atmosphere is 80 percent oxygen 20 percent carbon dioxide. Alternatively, the modified atmosphere can comprise atmospheric oxygen in an amount less than 5% by volume (preferably less than 1%, less than 0.5%, less than 0.1%, and even less than 0.05%). Alternatively, the package is a vacuum skin package, in which the atmosphere is substantially evacuated from within the package, e.g., from 1 to 99.999% evacuated (preferably from 99 to 99.999% evacuated, or from 99.5 to 99.999% evacuated).

The upper web of the absorbent pad preferably comprises a thermoplastic polymer, more preferably at least one member selected from the group consisting of olefin homopolymer, olefin copolymer, polyester, and polyamide. Especially preferred polymers for the upper web include at least one member selected from the group consisting of ethylene homopolymer, propylene homopolyrner, ethylene copolymer, propylene copolymer, polyester, and polyamide. More particularly, the upper web can include at least one member selected from the group consisting of linear low density polyethylene, high density polyethylene, very low density polyethylene, homogeneous ethylene/alpha-olefin copolymer (as described in U.S. Pat. No. 5,834,077, to Babrowicz, hereby incorporated by reference thereto), low density polyethylene, and polystyrene. Preferably, the upper web of the absorbent pad is water-impermeable, e.g., preferably has no holes therein.

While the lower web comprises fiber which can be woven, knitted, etc, preferably the lower web of the absorbent pad comprises nonwoven fibers. While the fiber can be any thermoplastic or thermosetting polymer, preferably the fiber comprises at least one member selected from the group consisting of polyolefin, polyester, and polyamide. Preferred polyolefins include polyethylene and polypropylene. More preferably, the lower web is made from spunbonded polyester and/or spunbonded polypropylene. Since polyolefin, polyester, and polyamide fibers are hydrophobic, the lower web preferably further comprises a hydrophilic composition so that the lower web will cause the pad to absorb liquid at a desired rate. Preferred hydrophilic compositions include hydrocarbon surfactants selected from polysorbates, ethoxylated linear alcohols, fatty amine oxides, alkanolamides and block copolymers of ethylene oxide and propylene oxide and dimethylsiloxane based that are coupled to polar groups such as poly(oxyethylene) containing the hydrophilic moiety, and mixtures thereof. Preferably, the hydrophilic composition is present on the second web in an amount of from about 0.1 to 10 weight percent, based on the weight of the second web, more preferably from 0.1 to 1 weight percent.

Preferably the absorbent layer comprises a layer of wood fluff and a layer of tissue paper. Preferably the tissue paper is wet strength tissue paper, in order to provide increased permeability and wicking of liquid into the pad. Optionally, the absorbent layer further comprises superabsorbent. Superabsorbents include cross-linked hydrophilic non-ionic polymer, as well as highly crosslinked solvating ionic polymer that contains dissociated ionic functional groups. Homopolymer and copolymers of acrylamide, and acrylic acid, are examples of nonionic superabsorbents. Sodium carboxymethylcellulose is an example of an ionic superabsorbent. The superabsorbent can be present in the form of granules and/or fiber.

The upper and lower webs can be directly attached to one another with a heat seal. Alternatively, the upper and lower webs are attached with an adhesive. Preferably, the adhesive is utilized at a level of from 1 to 20 grams per square meter, more preferably 1 to 10 grams, more preferably 5 to 9 grams.

The support member can comprise foam, preferably polystyrene foam. A preferred support member is a foam tray having a multilayer film adhered to the upper surface thereof, the multilayer film having a layer which serves as a barrier to oxygen.

As a second aspect, the present invention is directed to a packaged product comprising a food product which exudes juice in a case-ready package in accordance with the first aspect of the present invention. Preferably, the food product comprises at least one member selected from the group consisting of meat, poultry, cheese, and produce.

As a third aspect, the present invention pertains to a process for making a caseready package for containing a food product which exudes juice. The process comprises the steps of: (A) placing a product to be packaged on a support member having a base; (B) placing an absorbent pad on the support member; (C) evacuating atmosphere from around the product and support member; and (D) placing a lid member over the product and the support member so that the product is surrounded by the lid and the support member. The absorbent pad is in accordance with the first aspect of the present invention. Optionally, the atmosphere within the package is modified after evacuation of the atmosphere but before placing the lid member over the product and support member.

DESCRIPTION OF THE PREFERRED EMBODIMENTS

Figure 1:
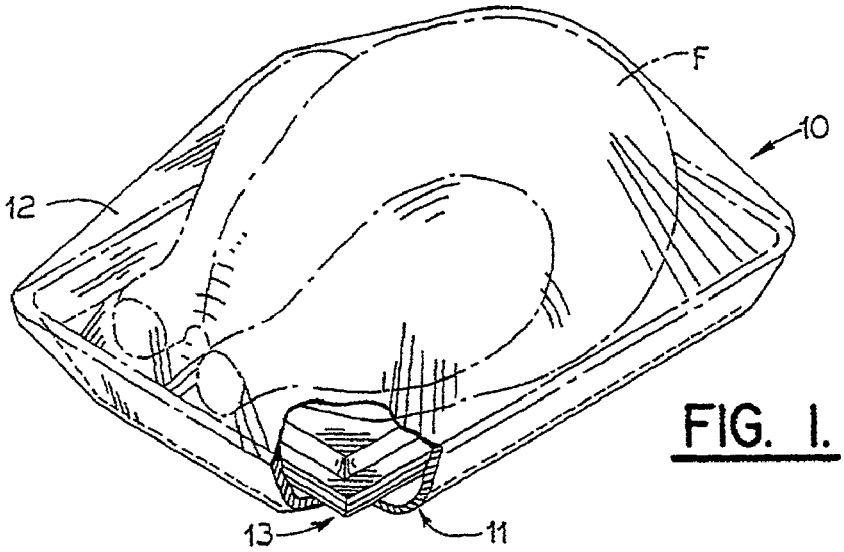
FIG. 1 is a perspective view of a food package embodying the features of the present invention.

Referring more specifically to the drawings, there is shown in FIG. 1 one form of a case-ready food package 10 embodying various features in accordance with the present invention. As illustrated, food package 10 includes tray 11 (also referred to as support member 11), lid or overwrap 12, and absorbent pad 13 located between tray 11 and the food product F within the package. Tray 11 and overwrap 12 are preferably made from conventional materials such as polystyrene foam and polyethylene film, respectively.

Figure 2:
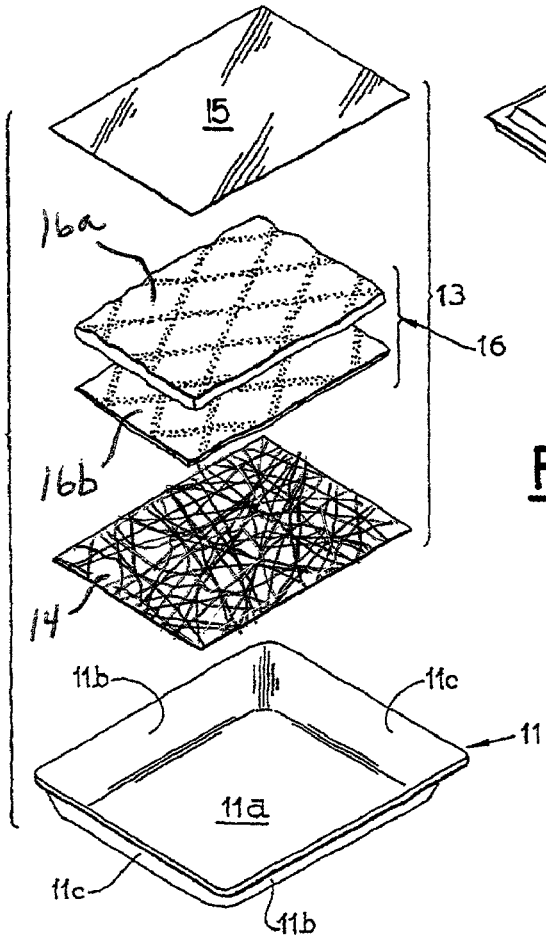
FIG. 2 is an exploded perspective view of an absorbent pad and food tray embodying the features of the present invention.

As illustrated in FIG. 2, tray 11 comprises bottom wall 11*a*, side walls 11*b* and end walls 11*c* integrally formed to provide a receptacle for receiving and containing therein food product F. While preferred, tray 11 is by no means the only type or form of container for the food product. Such containers may be in any form currently employed in packaging food products for display, storage, etc. For example, it is well known that food products may also be packaged in plastic film bags, molded fibrous trays or paperboard boxes.

The tray can have any desired configuration or shape, e.g., rectangular, round, oval, etc. Similarly, a flange on the tray may have any desired shape or design, including a simple, substantially flat design as shown, or a more elaborate design such as, e.g., those disclosed in U.S. Pat. Nos. 5,348,752 and 5,439,132, the disclosures of which are hereby incorporated in their entireties, by reference thereto. Alternatively, the tray may be in the form of a substantially flat sheet.

Suitable materials from which the tray can be formed include, without limitation, polyvinyl chloride, polyethylene terephthalate, polystyrene, polyolefins such as high density polyethylene or polypropylene, paper pulp, nylon, polyurethane, etc. The tray may be foamed (expanded) or non-foamed as desired, and preferably provides a barrier to the passage of oxygen therethrough, particularly if used for packaging products that are oxygen-sensitive (i.e., those that degrade in the presence of oxygen, such as meat, poultry, pork, produce, various cheeses, etc.). If such oxygen-sensitive products are to be packaged in a low-oxygen environment (to thereby extend their shelf-life), the tray preferably allows less than or equal to about 1000 cc of oxygen to pass therethrough (per square meter of material per 24 hour period at 1 atmosphere and at a temperature of 73° F.), more preferably less than about 500 cc of oxygen, more preferably still less than about 100 cc, even more preferably less than about 50 cc, and most preferably less than about 25 cc of oxygen to pass. The tray may be formed from a material which itself provides a barrier to the passage of oxygen, e.g., vinylidene chloride copolymer, nylon, polyethylene terephthalate, ethylene/vinyl alcohol copolymer, etc. Alternatively, support member 11 may have a substantially gas-impermeable sealant film laminated or otherwise bonded to the inner (upper) surface thereof as disclosed in U.S. Pat. No. 5,118,561, the disclosure of which is hereby incorporated, in its entirety, by reference thereto. As used herein, the phrase "sealant film" refers to a film which is conformably bonded to at least one of the exterior surfaces of the product support member. Preferably, the sealant film is bonded to the upper,as opposed to the lower, exterior surface of the tray and is a substantially gas-impermeable film. The sealant film preferably includes an oxygen-barrier material such as e.g., vinylidene chloride copolymer (saran), nylon, polyethylene terephthalate, ethylene/vinyl alcohol copolymer, etc.

In one preferred embodiment, the lid is made from a flexible film comprising an upper first film component which is peelably separable from a lower second film component, using a peel force of from about 0.001 to 2.5 pounds per inch, i.e., the bond strength between the first and second film components falls within the range of about 0.001 to 2.5 pounds per inch, more preferably 0.01 to 5 pounds per inch, more preferably, 0.02 to 0.05 pounds per inch. The first film component is substantially gas impermeable while the second film component is gas-permeable. As used herein, the phrase "gas-permeable" refers to a film or film portion which admits at least about 1,000 cc of gas, such as oxygen, per square meter of film per 24 hour period at 1 atmosphere and at a temperature of 73° F. (at 0% relative humidity). More preferably, a gas-permeable film or film portion admits at least 5,000, even more preferably at least 10,000, such as at least 15,000, 20,000, 25,000, 30,000, 35,000, 40,000, and 50,000, and most preferably at least 100,000 cc of oxygen per square meter per 24 hour period at 1 atmosphere and at a temperature of 73° F. (at 0% relative humidity).

As used herein, the phrase "substantially gas-impermeable" refers to a film or film portion which admits less than 1000 cc of gas, such as oxygen, per square meter of film per 24 hour period at 1 atmosphere and at a temperature of 73° F. (at 0% relative humidity). More preferably, a substantially gas-impermeable film admits less than about 500, such as less than 300, and less than 100 cc of gas; more preferably still less than about 50 cc, and most preferably less than 25 cc, such as less than 20, less than 15, and less than 10 cc of gas per square meter per 24 hour period at 1 atmosphere and at a temperature of 73° F. (at 0% relative humidity).

When the first film component is gas-impermeable, it preferably includes one or more materials that provide a substantial barrier to the passage of gas, particularly oxygen, therethrough. Suitable materials include, e.g., vinylidene chloride copolymers (saran), nylon, polyethylene terephthalate, ethylene/vinyl alcohol copolymer, silicon oxides (SiOx), etc. If the second film component is gas-permeable, it may be constructed to have sufficient gas-permeability for the intended application by, e.g., formed from a highly gas-permeable material (e.g., polymethyl pentene), a chemically or mechanically altered film component (e.g., a perforated film component or a film component of reduced thickness), and combinations of the foregoing. In this manner, a product can be packaged, shipped, and stored in a controlled atmospheric state designed to maximize the shelf-life of the product, e.g., under vacuum or in a modified atmosphere, with a gas-impermeable upper first film component maintaining such controlled atmospheric state within the package. Subsequently, the package can be displayed for consumer purchase in another atmospheric state that serves to enhance the appearance of the product at the expense of shelf-life, e.g., air from the surrounding environment which causes fresh red meat, poultry, and pork to bloom, while the product remains enclosed in the same package. This is accomplished by peelably removing the upper, gas-impermeable first film component from the package and allowing air to come into contact with the product by way of the lower, gas-permeable second film component, which remains sealed to the support member and continues to enclose the product and protect it from contact with dirt, dust, moisture, and other external contaminates.

The lid film may be a multilayer, coextruded film having two adjacent layers at the interface of first and second components that adhere to one another with a relatively weak bond-strength, preferably ranging from about 0.001 to 2.5 pounds per inch as noted above. The inter-layer adhesion between such adjacent layers represents the weakest cohesive or adhesive bond so that the film will peel at the interface of first and second components when the film is subjected to a peel force of sufficient magnitude, i.e., higher than the adhesive force between the first and second film components. Peelable separation in this manner may be achieved by constructing the film such that one of the adjacent layers at the interface of components can comprise a non-polar material while the other adjacent layer at such interface comprises a polar material. For example, one of the adjacent layers may comprise non-polar polyethylene homopolymer or copolymer while the other adjacent layer comprises at least one material selected from the group consisting of polyamide, copolyamide, polyester, copolyester such as polyethylene terephthalate, polar polyethylene copolymers such as ethylene/vinyl alcohol, polycarbonate, polymethylpentene, polyvinylidene chloride copolymer, polyurethane, polybutylene homopolymer and copolymer, and polysulfone. Alternatively, one of the adjacent layers at the interface may comprise polyethylene homopolymer or copolymer while the other adjacent layer comprises polypropylene homopolymer or copolymer. Preferred examples of multilayer, coextruded films that are suitable for a film in accordance with the present invention are described in the above-referenced U.S. Pat. No. 5,770,287 (Miranda et al.).

Figure 3:
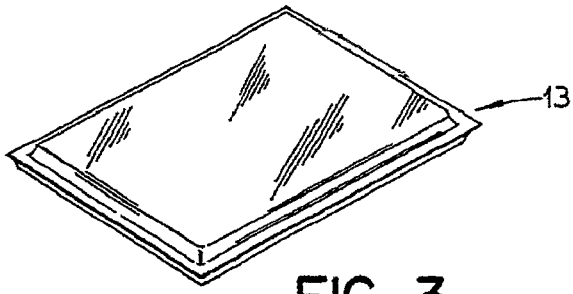
FIG. 3 is a perspective view of the pad shown in FIG. 2.

As shown in FIG. 1, absorbent pad 13 preferably rests on the bottom wall 11*a* of tray 11 and is adapted to receive the food product F thereon. Absorbent pad 13 will therefore typically have the food product thereon, with pad 13 being adapted to absorb exudants in the form of juices, water or the like exuded from the food product during display, storage, and handling and even during microwave or conventional oven cooking. As shown in FIG. 2 and FIG. 3, absorbent pad 13 comprises upper web 15 and lower web 14. Upper web 15 is preferably a flexible, non-perforated plastic film which is substantially impermeable to water. Lower web 14 is highly permeable to water and air, and preferably is a nonwoven fibrous web containing fiber made from a hydrophobic polymer such as polypropylene or polyester.

Preferred nonwoven webs for lower web 14 include Reemay® spunbonded polyester (polyethylene terephthalate), Typar® nonwoven spunbonded polypropylene (also known as Tekton® nonwoven spunbonded polypropylene), both of which are available from Reemay, Inc. of Old Hickory, Tenn. Other nonwoven webs include Avgol® nonwoven polypropylene, obtainable from John Cleaver Associates of Aaoli, Pa., and BBA® nonwoven polypropylene, obtainable from BBA, of Simpsonville, S.C.

In order that the pad will take up liquid at the desired rate, a hydrophilic composition is applied to the hydrophobic fiber from which the lower web is formed. Although any hydrophilic composition could be used, preferred compositions include Cirracol® PP842 fiber finish, obtainable from Uniquema (at www.uniquema.com). Cirracol® PP842 is a particularly preferred hydrophilic composition because all components in Cirrasol® PP842 have been cleared for use as an Indirect Food Additive, so Cirrasol® PP842 can be used in applications where direct food contact is desired. Preferably, the hydrophilic composition is applied to the lower web in an amount of from about 0.05 to 1 percent, based on the weight of the nonwoven web, more preferably, from about 0.1 to 0.8 weight percent, more preferably from about 0.2 to 0.4 percent. The hydrophilic composition, when added to the nonwoven lower web, provides the lower web with wicking properties so that the absorbent layer quickly takes up excess liquid exuded from the product.

Upper web 15 is preferably made of a water-impermeable plastic film so that the absorbent pad does not draw moisture directly from the food product into the pad. Preferably, upper web 15 is made from a suitable plastic film such as at least one member selected from the group consisting of polyethylene, polypropylene, polyester, and polyamide. High density polyethylene is particularly preferred. The upper web preferably has a thickness of from about 0.2 mil to about 2 mils, more preferably from about 0.3 mil to about 1.5 mils, more preferably from about 0.5 mil to about 0.75 mil. Preferably, the upper web is free of holes therethrough.

If the product is to be cooked in the package in the presence of the absorbent pad, upper web upper web 15 is preferably made from a polyester film coated with polyester (preferably biaxially oriented polyester) such as Mylar® M-30 sold by DuPont, or a polyester film coated with an amorphous polyester seal layer such as Mylar® Type 50 XM-101 also sold by DuPont, or Melinex® 850H sold by ICI, which is a coextruded one side heat sealable polyester film.

Lower web 14 and upper web 15 each extend outwardly past absorbent layer 13. In this extending area, lower web 14 and upper web 15 are attached directly to one another, without the absorbent layer 13 being therebetween in the area of attachment. In this manner, upper web 15 and lower web 14 "envelop" absorbent layer 13. Although upper web 15 can be directly attached to lower web 14 with a heat seal, preferably the upper and lower webs are attached to one another around their perimeter using an adhesive, preferably a hot melt adhesive (e.g., melting at from 200° F. to 400° F.), or a liquid adhesive.

A preferred adhesive is a semi-pressure-sensitive adhesive based on a polymeric component mixed with tackifier and a wax. A preferred primary polymeric component is an aromatically-modified $C_5$ petroleum hydrocarbon resin. A particularly preferred polymeric component is Wingtack® 86, made by Goodyear Tire and Rubber Co, which preferably makes up from 40 to 55 percent of the total weight of the adhesive. The secondary polymeric component of the adhesive is preferably an amorphous polymerized alpha-olefin such as a propylene polymer. A particularly preferred secondary polymeric component is RT2304 1-propene polymer with ethene (present in an amount of from 15-25 percent), made by Huntsman Corp of Salt Lake City, Utah. Alternatively, the secondary polymeric component can be RT2315 (present in an amount of from 25 to 35 percent), also from Huntsman. Indopol® H300 isobutylene/butene copolymer, obtained from Amoco Corporation, is a preferred tackifier, it being present at a level of from 1 to 5 percent. Irganox® 1010, obtained from Ciba-Geigy, of McIntosh, Ala., is a preferred antioxidant, it being present at a level of from 0.01 to 0.5 percent. Irgaphos® 168 is a preferred free radical stabilizer, obtained from Ciba-Geigy, of McIntosh, Ala., it being present at a level of from 0.01 to 0.5 percent. A blend of the above polymeric components, tackifier, and antioxidant was obtained from Henkel Adhesives of Lewisville, Tex., as well as from National Starch and Chemical of Bridgewater N.J.

Pad 13 further includes intermediate layer 16 of absorbent material disposed between, and enveloped by, upper and lower webs 15 and 14, which extend outwardly from intermediate layer 16. Intermediate layer 16 comprises mat 16*a* of absorbent fibers, such as several layers of absorbent tissue paper or a relatively thick layer of wood fluff fibers, which is relatively inexpensive and highly absorbent. When a wood fluff mat is used, it is desirable to isolate the loose, very short wood fluff fibers at a location in the absorbent layer 16 which is away from permeable lower web 14. A layer of tissue paper 16*b* is therefore placed between mat 16*a* and the permeable lower web 14, to act as a mechanical barrier between permeable lower web 14 and the short wood fluff fibers. Tissue paper 16*b* may be any suitable layer of tissue paper, such as that commonly referred to as facial grade tissue paper or wet strength tissue paper.

The absorbent layer can (optionally, but preferably) further comprise a component which is a superabsorbent, present in the form of fibers, granules, or any other suitable form. Some chemical compounds that have been found particularly effective as superabsorbents include a carboxy-methyl-cellulose superabsorbent compound and an acrylic superabsorbent (acrylic acid and sodium acrylate copolymer) compound. Both of these chemical compounds are USDA/FDA approved or approvable chemical compounds that can be used in connection with processed meat products. Other superabsorbent chemical compounds can also be used in the absorbent layer, as desired. Superabsorbent fiber having a length of about 3 mm is available under the OASIS™ from Technical Absorbents Ltd, as disclosed in UK Patent Application 2 325 195, published Nov. 18, 1998, entitled "Absorbent Pad". Preferred superabsorbent granules are FAVOR-PAC 100™, obtained from Stockhausen, of Greensboro, N.C. These granules have a particle size of 100 to 850 microns, and are preferably present in the pad in an amount of from about 0.1 to 50 weight percent, more preferably from about 1 to 30 weight percent.

The various terms and phrases utilized throughout this document are to be given their ordinary meaning as understood by those of skill in the art, except and to the extent that any term or phrase used herein is referred to and/or elaborated upon in co-pending U.S. Ser. No. 09/163,747, filed Sep. 30, 1998, hereby incorporated in its entirety by reference thereto, which supplements the ordinary meaning of all terms, phrases, and other descriptions set forth herein.

In the figures and specification, there have been disclosed preferred embodiments of the invention. All sub-ranges of all ranges disclosed are included in the invention and are hereby expressly disclosed. While specific terms are employed, they are used in a generic and descriptive sense only, and not for the purpose of limiting the scope of the invention being set forth in the following claims.

What is claimed is:

1. A case-ready package for containing a food product which exudes juice, comprising:

(A) a support member;

(B) a lid member comprising a flexible film; and (C) an absorbent pad comprising:

(i) an upper web comprising a flexible film;

(ii) a liquid-permeable lower web comprising nonwoven fiber having a hydrophilic composition thereon, the nonwoven fiber comprising at least one member selected from the group consisting of polyolefin, polyamide, and polyester; and (iii) an absorbent layer between the upper web and the lower web;

wherein the upper and lower webs each extend outward of the absorbent layer, the upper and lower webs being attached to one another around an entire outer perimeter portion of the pad, with the upper and lower webs together surrounding and containing the absorbent layer, and the case-ready package further comprising modified atmosphere or vacuum between the support member and the lid member.

2. The case-ready package according to claim 1, wherein the modified atmosphere comprises oxygen in an amount of from 60 to 80 percent, based on total atmospheric weight within the package.

3. The case-ready package according to claim 1, wherein the modified atmosphere comprises atmospheric oxygen in an amount less than 5% by volume.

4. The case-ready package according to claim 1, wherein atmosphere has been substantially evacuated from within the package.

5. The case-ready package according to claim 1, wherein the upper web of the absorbent pad comprises at least one member selected from the group consisting of olefin homopolymer, olefin copolymer, polyester, and polyamide.

6. The case-ready package according to claim 5, wherein the upper web of the absorbent pad comprises at least one member selected from the group consisting of ethylene homopolymer, propylene homopolymer, ethylene copolymer, propylene copolymer, polyester, and polyamide.

7. The case-ready package according to claim 1, wherein the upper web of the absorbent pad is water-impermeable.

8. The case-ready package according to claim 1, wherein the nonwoven fibers comprise at least one member selected from the group consisting of polyethylene, polypropylene, polyester, and polyamide.

9. The case-ready package according to claim 1, wherein the absorbent layer comprises a layer of wood fluff and a layer of tissue paper.

10. The case-ready package according to claim 1, wherein the absorbent layer further comprises superabsorbent.

11. The case-ready package according to claim 10, wherein at least some of the superabsorbent is present in granular form.

12. The case-ready package according to claim 1, wherein the upper and lower webs are attached with a heat seal.

13. The case-ready package according to claim 1, wherein the upper and lower webs are attached with an adhesive.

14. The case-ready package according to claim 1 wherein the support member comprises foam.

15. The case-ready package according to claim 1, wherein the hydrophilic composition comprises at least one member selected from the group consisting of polysorbate, ethoxylated linear alcohol, fatty amine oxide, alkanolamide, and block copolymers of ethylene oxide or propylene oxide with dimethylsiloxane that are coupled to polar groups containing a hydrophilic moiety.

16. The case-ready package according to claim 15, wherein the hydrophilic composition is present on the second web in an amount of from about 0.1 to 10 weight percent, based on the weight of the lower web.

17. A packaged product comprising a food product which exudes juice in a case-ready package comprising:

(A) a support member;

(B) a lid member comprising a flexible film; and (C) an absorbent pad comprising:

(i) an upper web comprising a flexible film;

(ii) a liquid-permeable lower web comprising nonwoven fiber having a hydrophilic composition thereon, the nonwoven fiber comprising at least one member selected from the group consisting of polyolefin, polyamide, and polyester; and (iii) an absorbent layer between the upper web and the lower web;

wherein the upper and lower webs each extend outward of the absorbent layer, the upper and lower webs being attached to one another around an entire outer perimeter portion of the pad, with the upper and lower webs together surrounding and containing the absorbent layer, and the case-ready package further comprising modified atmosphere or vacuum between the support member and the lid member.

18. The packaged product according to claim 17, wherein the food product comprises at least one member selected from the group consisting of meat, poultry, cheese, and produce.

19. A process for making a case-ready package for containing a food product which exudes juice, comprising:

(A) placing a product to be packaged on a support member having a base;

(B) placing an absorbent pad on the support member, the absorbent pad comprising:

(i) an upper web comprising a flexible film;

(ii) a liquid-permeable lower web comprising nonwoven fiber having a hydrophilic composition thereon, the nonwoven fiber comprising at least one member selected from the group consisting of polyolefin, polyamide, and polyester; and (iii) an absorbent layer between the upper web and the lower web;

wherein the upper and lower webs each extend outward of the absorbent layer, the upper and lower webs being attached to one another around an entire outer perimeter portion of the pad, with the upper and lower webs together surrounding and containing the absorbent layer, and the case-ready package further comprising modified atmosphere or vacuum between the support member and the lid member;

(C) evacuating atmosphere from around the product and support member;

(D) placing a lid member over the product and the support member so that the product is surrounded by the lid and the support member.

20. The process according to claim 19, further comprising surrounding the product and support member with a modified atmosphere after evacuation of the atmosphere bit before placing the lid member over the product and support member.

* * * * *